United States Patent [19]

Speidel

[11] 3,952,574

[45] Apr. 27, 1976

[54] PROCESS AND APPARATUS FOR FORMING SHEET METAL STRUCTURES

[76] Inventor: John A. Speidel, 7205 Kings Mills Road, Maineville, Ohio 45039

[22] Filed: Oct. 31, 1974

[21] Appl. No.: 519,430

[52] U.S. Cl. ..... 72/379; 72/381; 113/116 F; 113/116 V

[51] Int. Cl.[2] ..... B21D 11/20

[58] Field of Search ..... 72/383, 387, 379, 381; 113/116 F, 116 G, 116 V, 116 AA, 116 HH

[56] References Cited

UNITED STATES PATENTS

| | | | |
|---|---|---|---|
| 1,153,313 | 9/1915 | Katzinger | 113/116 |
| 1,722,177 | 7/1929 | Combemale | 113/116 |
| 2,021,118 | 11/1935 | Tinkham | 72/381 |
| 2,244,912 | 6/1941 | Kollander | 113/116 |
| 2,591,439 | 4/1952 | Koch | 72/383 |
| 2,950,656 | 8/1960 | Gewiss | 93/1 |
| 3,862,562 | 1/1975 | Kruger | 72/387 |

*Primary Examiner*—Lowell A. Larson
*Attorney, Agent, or Firm*—Jennings, Carter & Thompson

[57] ABSTRACT

A new process of folding sheet metal to form various kinds of structures. The characteristic feature of each of the structures capable of being formed by the invention is that they are developable without slitting and have at least two adjacent surface segments which together, or in combination with each other if more than two are present, form a complex surface, developable without slitting. The structure consists of one or more of the types of surfaces known as plane, cylindrical, conical and convolute surfaces arranged in such relation that straight bend lines upon the complex surface and the images thereof when projected on the pattern meet within the confines of the surface and pattern at other than a straight line extending from edge to edge of the complex surface and pattern, respectively. A specific form of the apparatus particularly adapted for carrying out the process also is disclosed. The principles of this apparatus may be used to form various useful objects, by the method described and claimed.

4 Claims, 36 Drawing Figures

Fig 21
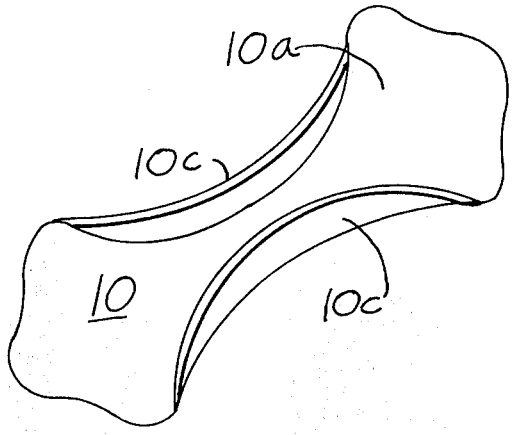
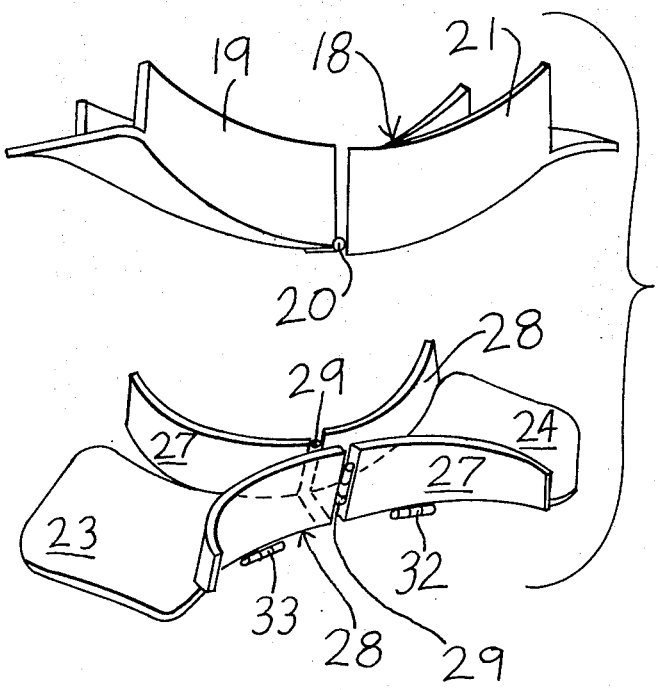
Fig 20

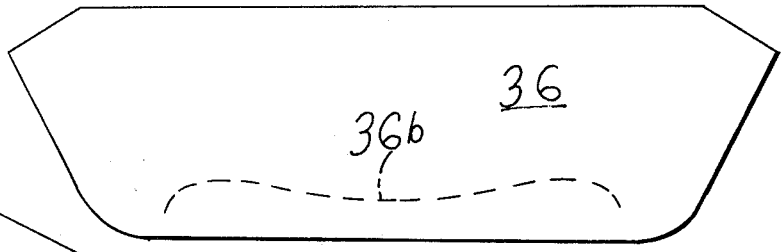
Fig 22
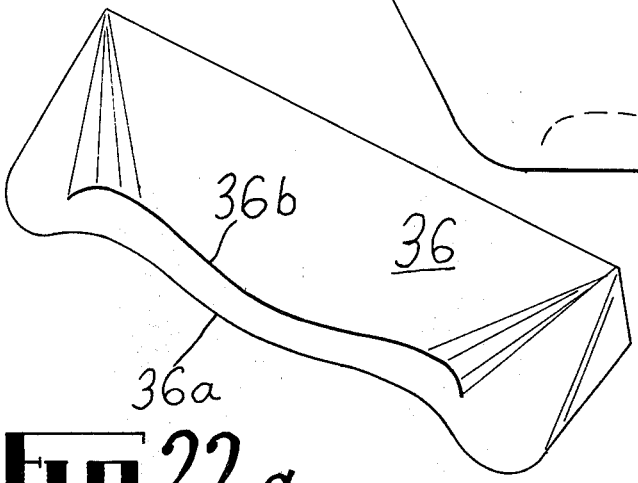
Fig 22a
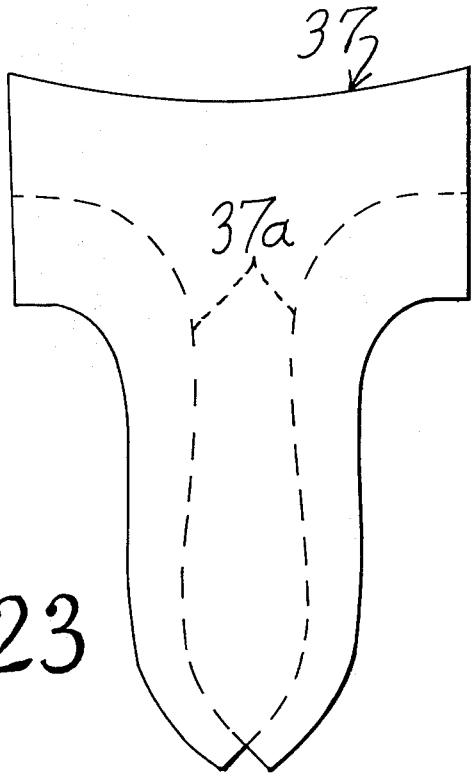
Fig 23
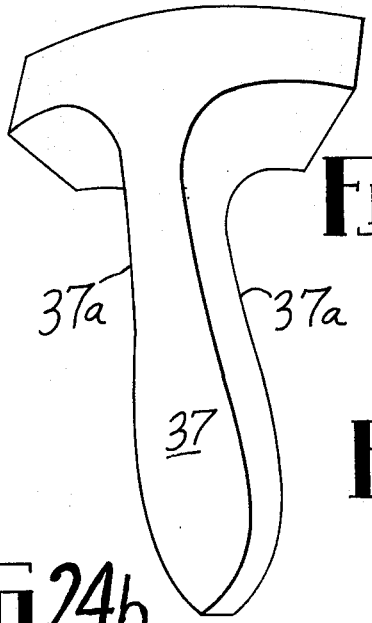
Fig 23a
Fig 24b
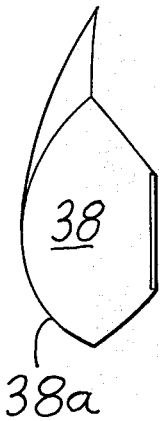
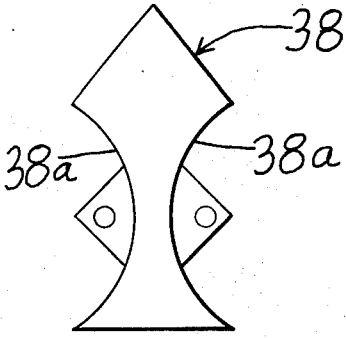
Fig 24a
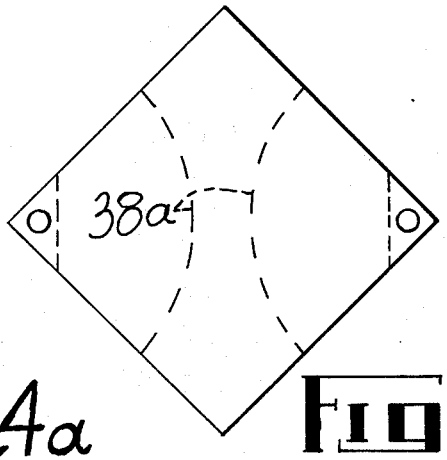
Fig 24

Fig 25a
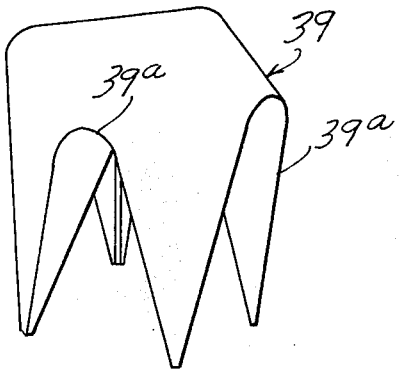
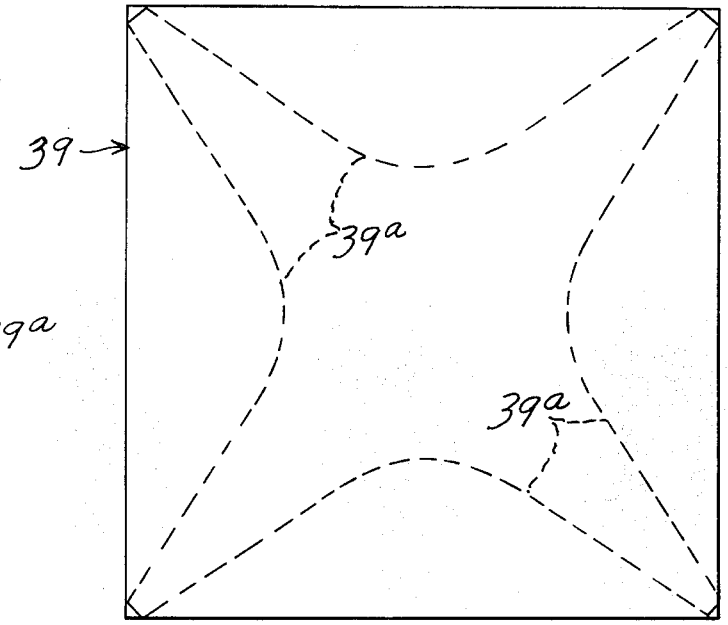
Fig 25
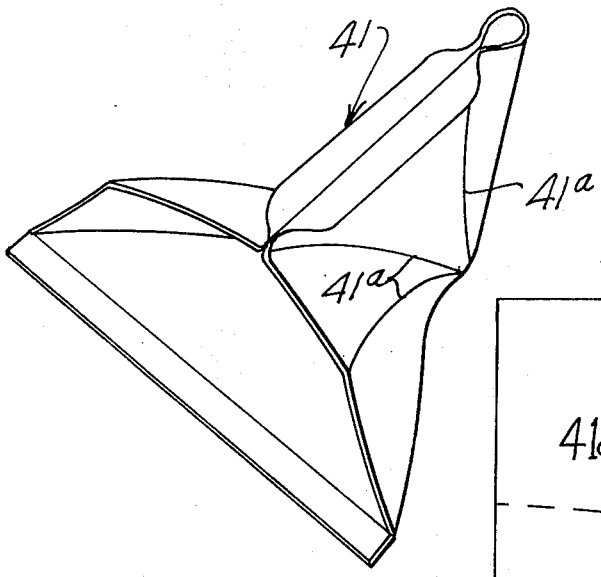
Fig 26
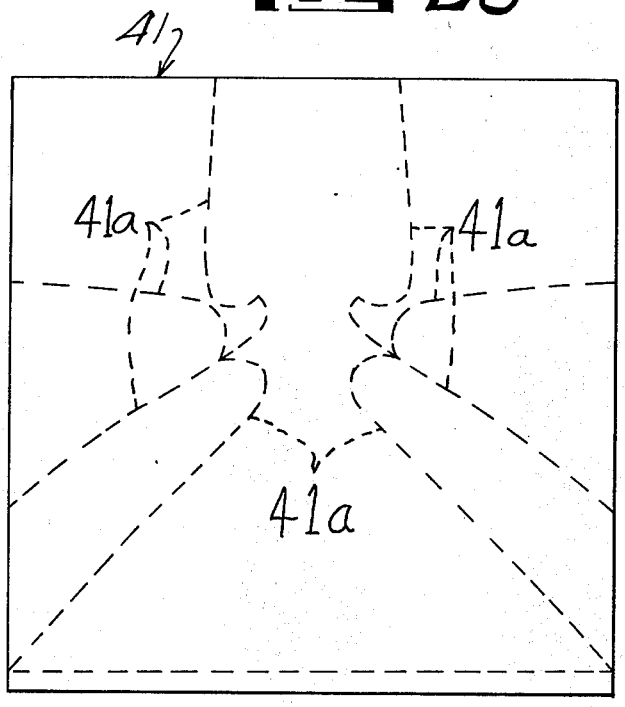
Fig 26a

PROCESS AND APPARATUS FOR FORMING SHEET METAL STRUCTURES

This invention relates to a process and apparatus for making useful articles from sheet metal.

A primary object of my invention is to provide an improved process and apparatus by means of which useful articles of sheet metal may be fabricated economically, quickly, with a minimum of labor, a minimum of outlay for tooling and which results in a formed sheet metal object characterized, throughout, by the absence of stretching, crumpling or tearing of the metal.

It is a further object of my invention to provide a process and apparatus of the character designated in which useful articles may be manufactured, the overall configuration of which articles depends solely upon the outline shape of the blank of sheet metal with which one starts, the arrangement of bend lines upon its surface and the degree and direction of bending of the various segments or portions of the sheet Stated differently, I propose in the carrying out of my improved process, when making any given, predetermined article, first to commence the bending of the article along the required bend line or lines and subsequently, by the application of forces in the correct directions to bend the metal about such lines in such fashion as to result in the finished article being composed of portions all of which are made up of developable surfaces, such that the straight bend lines upon the complex surfaces and the images thereof when projected on the pattern, meet within the confines of the surface and pattern at other than a straight line extending from edge to edge of the complex surface and pattern, respectively.

In order that my invention may be more definitely understood and appreciated, I will now discuss some of the geometrical theory and definitions and terms involved. First, the recognized meaning of the word "bend" is to turn, to incline, to deflect, or to become curved, to be turned toward or away from something. The recognized meaning of the word "fold" is to double, to bend over, to enclose, to wrap up. In view of the equivalence of the meaning of these two words as clearly apparent from their useage herein, the terms "bend line" and "fold line" are used interchangeably.

When a flat sheet of metal which is free to fold is subjected to an arrangement of forces as described hereinafter, the metal will fold along a curved fold line. Although the sheet is readily folded in the foregoing manner, restoring the sheet metal to its original flat condition is difficult because of the work hardening which has occurred along the curved fold line. I have found that the location and character of the curved fold lines may be controlled, and therefore used to great advantage in the manufacture of useful and decorative structures.

Plane, cylindrical, conical and convolute surfaces are developable ruled surfaces, the latter three being termed single-curved surfaces. Because single-curved surfaces have increased rigidity along the elements, also, when the elements meet the elements of other single curved surfaces along a fold line, forces are concentrated at the fold line permitting the completion of the fold by means of plates, without the requirement of matching dies. The structure gains strength through work hardening and through the interbracing action of the intersecting surfaces. As my invention becomes more readily understood, it will be seen that my improved method of folding sheet metal forms structures by simultaneous folding only. It therefore follows that only simultaneous unfolding would return the structure to its original flat condition. Therefore, application of force at any one point on the structure results in the distribution of the force throughout the structure, thus causing the structure to resist distortion. As stated above, the characteristic feature of structures folded from sheet metal by my improved process is that they are developable without slitting and have at least two adjacent surface segments which together, or in combination if more than two, form a complex surface, developable without slitting. The structure as a whole consists of one or more of the types of surfaces known as plane, cylindrical, conical and convolute surfaces, in arrangement such that straight bend lines upon the complex surface and the images thereof when projected on the pattern meet within the confines of the surface and pattern at other than a straight line extending from edge to edge of the complex surface and pattern, respectively. To fold a structure with the foregoing characteristic features from a flat unitary sheet without stretching, crumpling or tearing the sheet, requires folding along at least four straight bend lines which converge within the confines of the sheet. The bend across one bend line must be in the direction opposite to the bend across the other three bend lines and a certain spatial relationship among the bend lines must exist, as will be explained below. The bend lines in such a fold system must number at least four and they may increase to an infinite number. Folding must always be in two directions and all folds must be made simultaneously.

Sheet metal bends more readily than it stretches. Because of this factor the surfaces which will be formed from a flat sheet of metal on application of properly located forces will be ruled, developable surfaces. (It is here noted that the term "applicable surfaces" is used in some textbooks as synonymous with "ruled developable surfaces.") When sheet metal is subjected to forces along a minimum of four lines, as hereinafter explained, the direction of one force being generally opposed to the direction of force along the other three lines, folding will occur. The geometric arrangement of the lines along which the forces are applied is discussed hereafter.

Apparatus illustrating features of my invention and which may also be used to carry out my improved process is shown in the accompanying drawings forming a part of this application in which.

Figure 5:
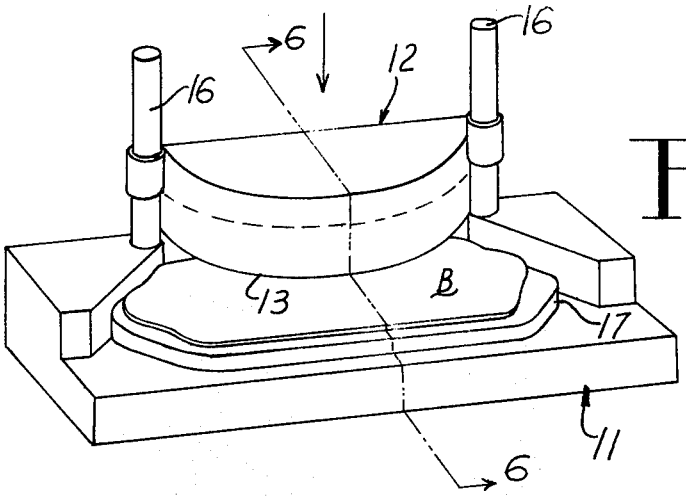
FIG. 5 is a somewhat diagrammatic isometric view of a form of mechanism which may be used to start the bend or bends in a blank from which a useful article is to be made.
Figure 6:
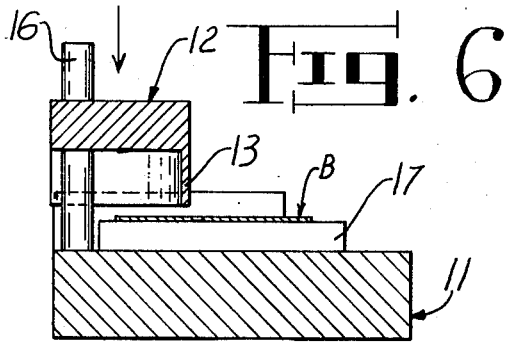
Figure 6A:
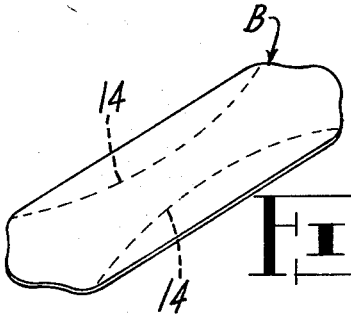
Figure 7:
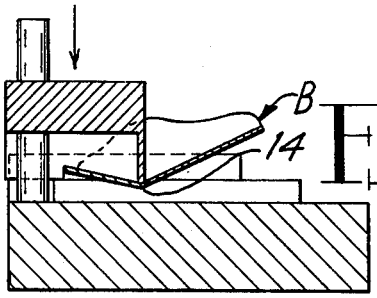
Figure 7A:
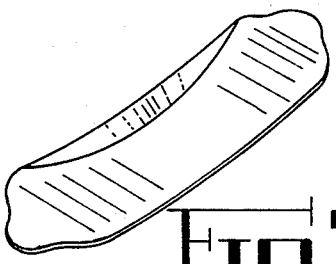
Figure 8:
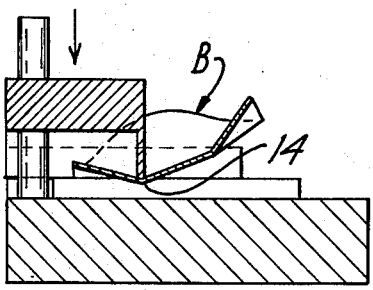
Figure 8A:
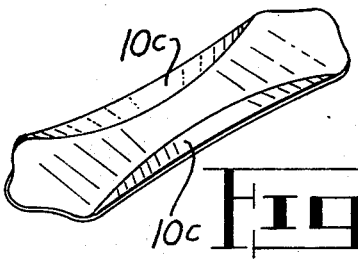
Figure 9:
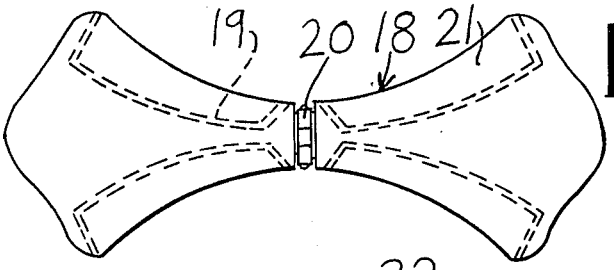
Figure 10:
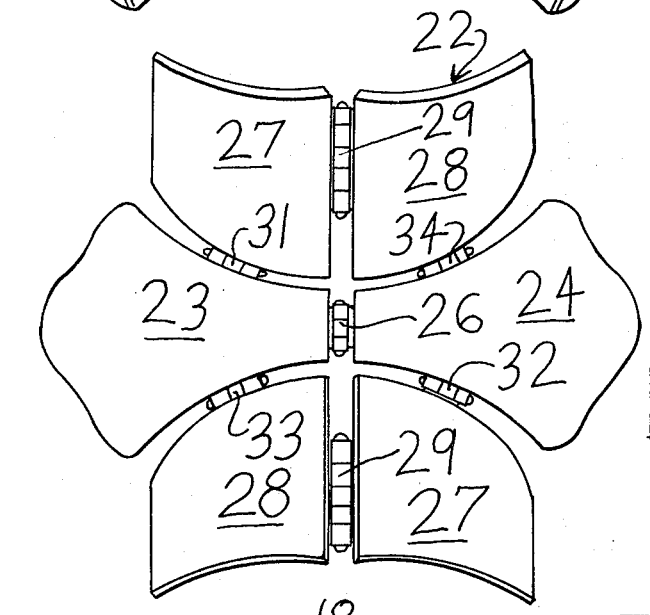
Figure 14A:
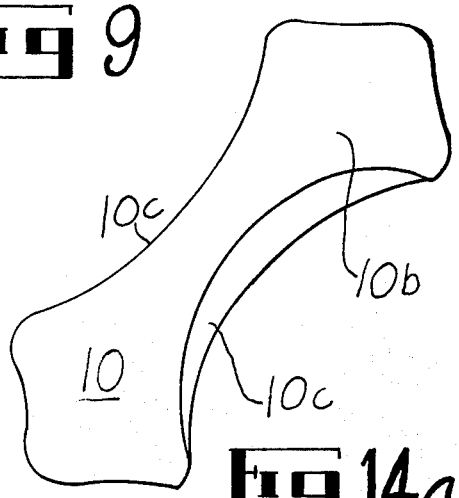
Figure 11:
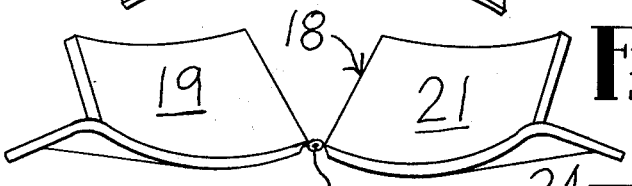
Figure 12:
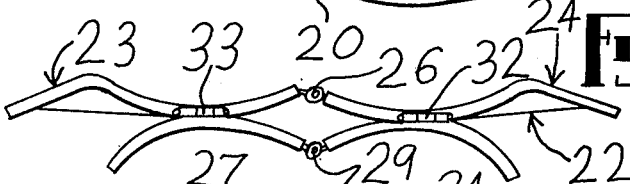
Figure 15:
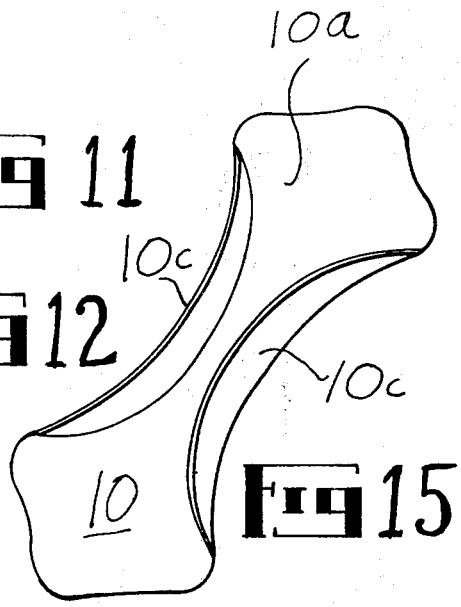
Figure 13:
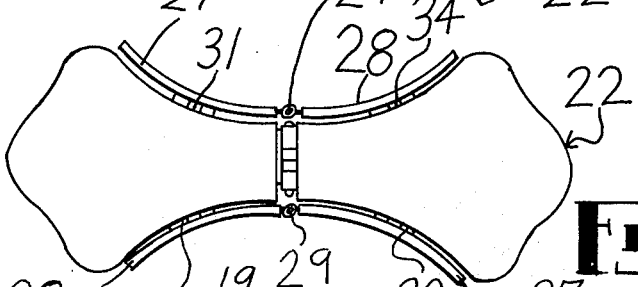
Figure 14:
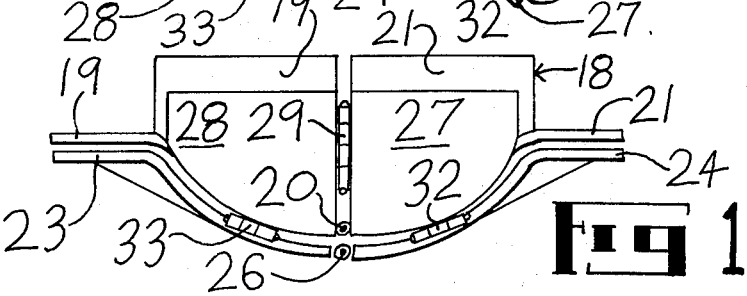
Figure 16:
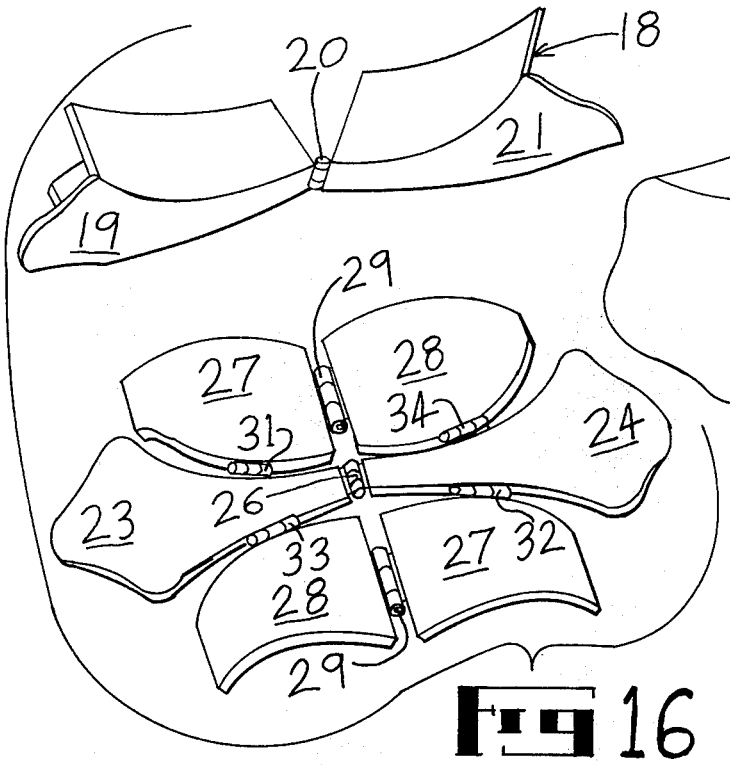
Figure 17:
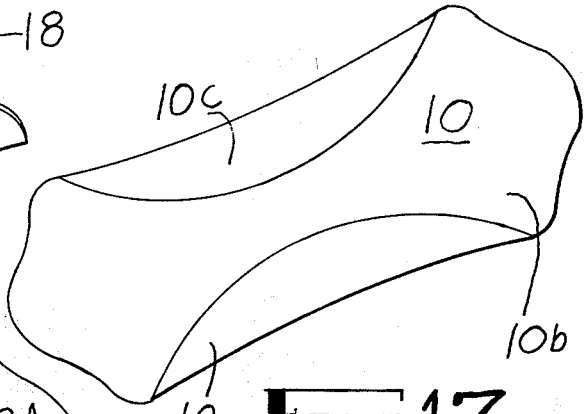
Figure 18:
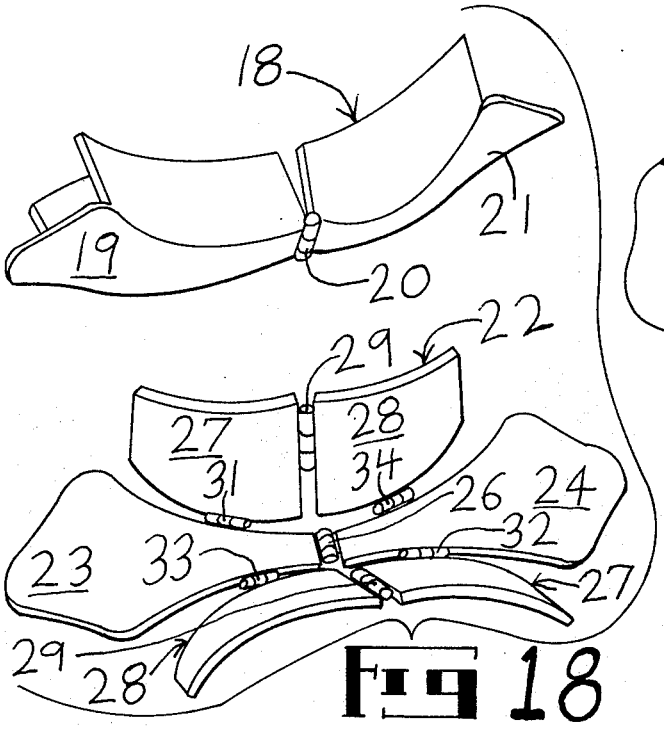
Figure 19:
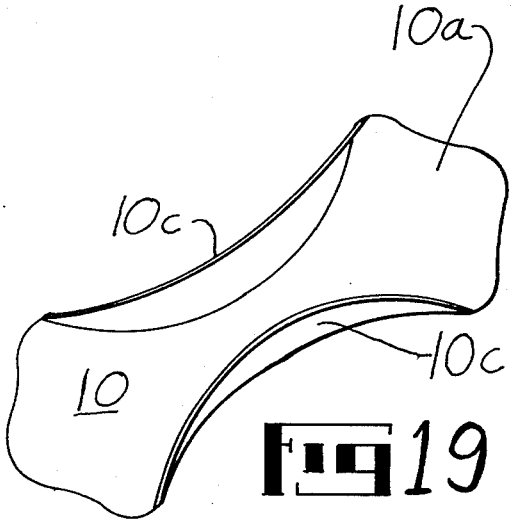

FIGS. 6 to 8, inclusive, are vertical sectional views taken generally along line 6—6 of FIG. 5 and illustrating the placement of the two partial bends upon a blank;

FIGS. 6A, 7A and 8A are isometric views of a blank of sheet metal related to the respective operations being formed thereupon in FIGS. 6, 7 and 8;

FIG. 9 is a plan view of the inner, hinged section of a folding mechanism, in unfolded position;

FIG. 10 is a plan view of the outer hinged section of a folding mechanism in unfolded view;

FIG. 11 is a side elevational view of the inner section of a folding mechanism shown in FIG. 9, in unfolded position;

FIG. 12 is a side elevational view, in unfolded position, of the outside section of the folding mechanism shown in FIG. 10;

FIG. 13 is a plan view of the outside folding mechanism shown in FIGS. 10 and 12, in folded position;

FIG. 14 is a side elevational view of the folding mechanism section shown in FIG. 9 and FIG. 10, mated and in folded position;

FIG. 14A is an isometric view looking from the outside of a piece of sheet metal which has been folded to form a handle, by the mechanism shown in FIGS. 9 to 14, inclusive;

FIG. 15 is an isometric view looking from the inside of the handle shown in FIG. 14A;

FIG. 16 is an exploded view of the inner and outer hinged sections of a folding mechanism, the parts being shown in their respective unfolded position;

FIG. 17 is a plan view of a blank for forming a handle, ready to be inserted into the folding mechanism shown in FIG. 16, the bend lines of which have been commenced by the mechanism shown in FIG. 5;

FIG. 18 is an exploded view of the inner and outer hinge sections of a folding mechanism, the parts being shown in partially folded position;

FIG. 19 is an isometric view of the blank as it would appear if it had been removed from the two hinge sections of the forming mechanism as they are shown in FIG. 18;

FIG. 20 is an exploded view of the inner and outer hinge sections of a forming mechanism in completely folded position;

FIG. 21 is an isometric view of a sheet metal handle which has been formed by the folding mechanism when those parts are in the position of FIG. 20;

FIG. 22 is a plan view of a blank for a vent hood for a range or stove;

FIG. 22A is the range hood or stove which may be formed by my improved process and apparatus from the blank of FIG. 22;

FIG. 23 is a plan view of a sheet metal blank for a table, stool or chair leg;

FIG. 23A is the completed leg which may be formed by my improved process using the blank of FIG. 23;

FIG. 24 is a plan view of a blank for forming a drawer pull;

FIG. 24A is a plan view of a drawer pull formed by my improved process and apparatus from the blank of FIG. 24;

FIG. 24B is a side elevational view of a drawer pull formed by my improved process using the blank of FIG. 24;

FIG. 25 is a plan view of the blank for forming a table;

FIG. 25A is the table formed by my improved process and apparatus from the blank of FIG. 25;

FIG. 26 is a plan view of a blank for forming a dust pan with pour spout; and, FIG. 26A is an isometric view of the dust pan with pour spout formed by my improved process and apparatus from the blank of FIG. 26.

There exists a class of structures whose characteristic feature is that they are developable without slitting and have at least two adjacent surface segments which together or in combination if more than two, form a complex surface, developable without slitting, which consists of one or more types of surfaces known as plane, cylindrical, conical and convolute surfaces, and, that in these complex surfaces the arrangements are such that the rule lines upon the complex surface and the images thereof when projected on the pattern, meet within the confines of the surface and pattern at other than a straight line extending from edge to edge of the complex surface and pattern, respectively, namely, the rule lines of the surfaces meet within the confines of the structure at:

a. a point or points;
b. a straight line, or lines, one end at least of which lines terminates short of the edge of the structure, namely, within the structure;
c. a curved line or lines; or,
d. various combinations of points as in (a) above, straight lines as in (b) above, or curved lines as in (c) above, and, that in all cases the projected images of said rule lines meet within the confines of the pattern at:
   a. a point or points;
   b. a straight line, or lines, one end at least of which lines terminates short of the edge of the pattern, namely, within the pattern;
   c. a curved line or lines; or,
   d. various combinations of points as in (a) above, straight lines as in (b) above, or curved lines as in (c) above.

To fold a structure with the foregoing characteristic feature from a flat unitary sheet without stretching, crumpling or tearing the sheet requires folding along at least four straight bend lines which converge within the confines of said sheet. The bend across one bend line must be in a direction opposite to the bends across the other three bend lines and a certain spatial relationship must exist among the bend lines as will be described below. In summary, the bend lines in such a fold system must number at least four, and may increase to an infinite number. Folding must always be in two directions and all folds must be made simultaneously.

In describing the folding of a developable structure whose characteristic feature is that described above, from a flat unitary sheet, folding along only the minimal number of straight bend lines required, namely four straight bend lines which converge at a point within the sheet, two of the four straight bend lines will be termed axial lines and the other two bend lines will be termed lateral lines. Within the meaning of this specification axial bend lines are:

a. the middle line of the three bend lines wherein bending occurs in the same direction, and
b. that line of the four wherein bending occurs in the direction opposite to the direction of bending of the other three.

Within the meaning of this specification lateral bend lines are the outer lines of the three wherein bending occurs in the same direction.

Figure 1:
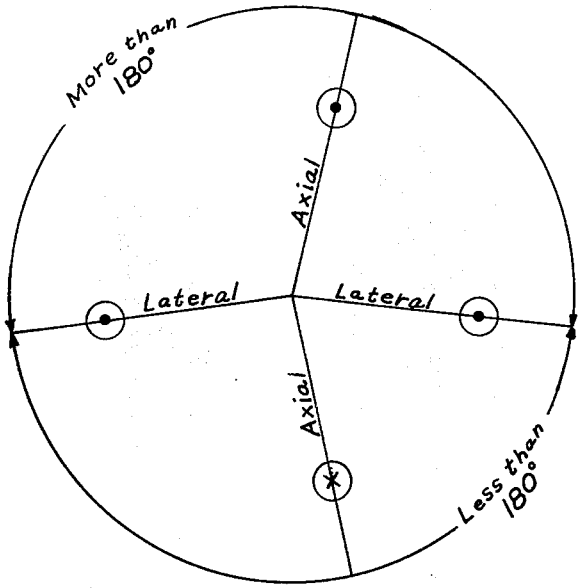
FIG. 1 is a wholly diagrammatic view illustrating the principles of folding in accordance with my invention.

Referring now to FIG. 1 of the drawings, it will be seen that I there show a circular blank intended to represent, for instance, a round blank of sheet metal. On this blank I have indicated the lateral and axial lines and also have indicated the required spatial relationship that must exist among the four bend lines in order to form a complex developable structure. In addition, the circles with the dots in the middles indicate that the particular line to which they are applied should be moved upwardly relative to the plane of the paper whereas the circle with the *x* in the middle indicates that the line to which it is applied should be bent downwardly relative to the plane of the paper.

Viewing FIG. 1 it will be seen that the spatial relationship that must exist among the four bend lines is as follows:

1. the images of the axial lines as projected on the pattern may form any angle including a straight angle;
2. the images of the lateral lines as projected on the pattern must not form a straight angle;
3. in view of (2), above, of the two angles formed considering the lateral lines as sides, one angle must be a reflex angle, namely, an angle greater than a straight angle and the other angle must be an angle smaller than a straight angle;
4. the projected image of the axial bend line wherein folding occurs in the direction opposite to that of the other three bend lines must lie within the angle which is smaller than a straight angle. Thus the projected image of the axial bend line wherein the direction of folding is the same as the direction of folding of the lateral lines must lie within the reflex angle of (3), above.

The disposition of four straight bend lines as set forth above is illustrated in FIG. 1 an inspection of which clearly shows that the projected image of each of the two axial lines may be located at any selected position within the confines of its respective angle formed by the projected images of the two lateral lines. The structure resulting from a folding operation, with a blank laid out as in FIG. 1, is obtained only by simultaneous folding.

Figure 2:
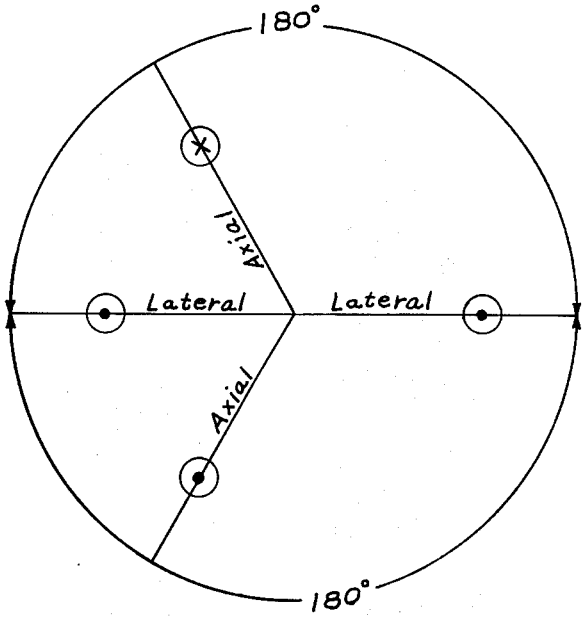
FIGS. 2, 3 and 4 are diagrammatic views illustrating inoperative arrangements of fold lines which will be used to explain the necessity for the arrangement of fold lines set forth in FIG. 1.
Figure 3:
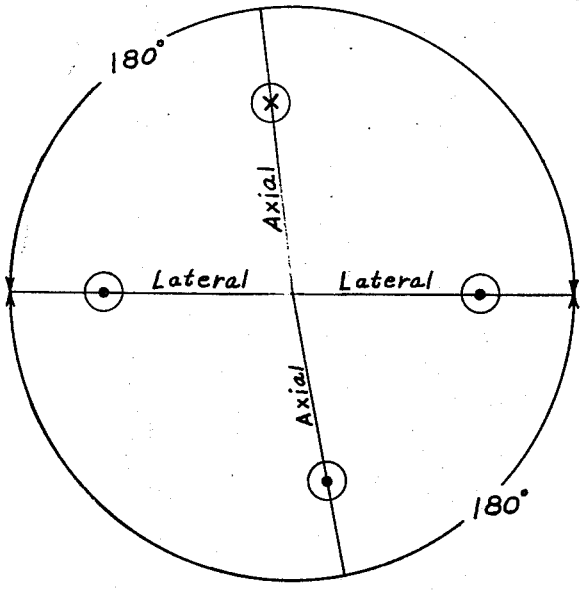
Figure 4:
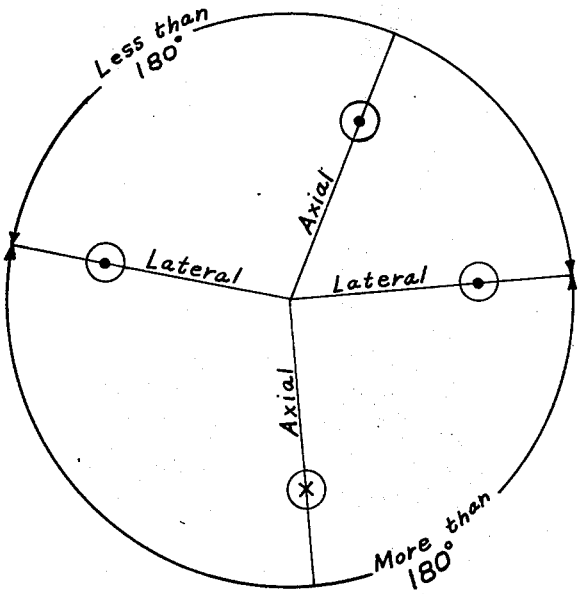

In order to appreciate the necessity of arranging the lateral and axial lines upon the blank as shown in FIG. 1 in order to obtain a developable structure, attention will now be called to FIGS. 2, 3 and 4.

In FIG. 2 I illustrate a condition in which the two lateral lines form a straight angle. In this instance, simultaneous folding is impossible without stretching, crumpling or tearing the sheet. Progressive folding is possible only under the condition that when the sheet is folded over against itself completely, thus forming a double sheet, that the axial bend lines are coincident; however, the resulting product will not be a structure heretofore described, but only a folded double sheet.

Referring now to FIG. 3 I illustrate a condition in which the lateral lines form a straight angle and in which the axial lines are so relatively disposed that they do not coincide when the sheet is doubled along the lateral lines. When the axial lines are not coincident, after the sheet is folded over against itself completely, further folding is impossible.

Referring to FIG. 4 I there illustrate a situation which is identical with FIG. 1 except that the axial line which bends in the same direction as the lateral lines is located in the angle which is less than a straight angle rather than being located in the angle which is greater than a straight angle as in FIG. 1. In this instance the blank of FIG. 4 will not fold either simultaneously or progressively, namely, folding along the bend lines is impossible without stretching, crumpling or tearing the material of the sheet.

In summary relative to what has been said so far with respect to FIGS. 1 to 4 inclusive, it will be seen that only when the axial and lateral lines are disposed upon the blank as illustrated by the system of folding in FIG. 1 can the structures disclosed herein be formed.

A structure having only four straight bend lines suitably disposed as illustrated in FIG. 1 has a developable complex surface composed of four plane surface segments. The two segments meeting along the axial bend line wherein the direction of folding is toward the viewer are a concave surface and the two segments meeting along the axial bend line wherein the direction of folding is away from the viewer are a convex surface.

The foregoing pattern of four straight bend lines wherein the direction of bending with respect to three of the same is in the direction opposite to that of the fourth, the bend lines being oriented as herein set forth and further in which simultaneous bending or unbending is essential, can be utilized in planned arrangements to create a wide variety of useful and pleasing structures. Since the projected images of the lateral bend lines do not form a straight angle upon the pattern, a plurality of such groups of four straight bend lines converging at a point, results in a curved bend line as the lateral bend lines become vanishingly small; the axial bend lines meet at each point from opposite directions, the bends across one of the axial bend lines being in the direction opposite of the bend across the other. Folding along such a curved bend line results in a developable complex surface composed of segments of intersecting single curved surfaces, part of the complex surface being convex and part being concave when viewed from the same side. All straight bend lines will be elements of single curved surface segments, or edges of plane surface segments.

By using one or more clusters of four or more straight bend lines, each cluster converging at a point upon the surface of a unitary sheet and, optionally, arranging clusters to form a curved bend line or lines, complex surfaces may be created which will be composed of one or more of the four developable surfaces, namely the plane, the cylinder, the cone and the convolute. Furthermore, a complex surface created according to these teachings is fully developable without slitting.

As a further word as background and to aid in the further understanding of my invention, in geometry a pyramid is defined as a solid figure bounded by plane surfaces of which one, the base, is a polygon of any number of sides, and the other surfaces are triangles having as bases the sides of the aforementioned polygon and meeting at a point, namely, the vertex, outside the plane of the polygon. Referring to the structure formed according to the pattern shown in FIG. 1, each pair of adjacent converging lateral and axial bend lines when combined with a line in space which intersects the said pair of bend lines at other than their point of intersection, results in a triangle. The basic building block of the class of structures under consideration herein therefore is a pyramidal shape, the structures being made up of a multiplicity of pyramidal shapes having in the limit, vanishingly small lateral bend lines in successive arrangements of the basic form. The pyramidal shapes are not solid figures as is readily apparent from the description of FIG. 1 which folds from the pattern shown into a fully developable complex surface which unfolds into the pattern shown. The structures made up of the aforementioned multiplicity of successive arrangements of the basic form are fully developable without slitting and the rule lines of the structures converge within the confines of the structures, and the projected images of the rule lines converge within the confines of the pattern.

While in pure geometric terminology wherein surfaces are considered to have no thickness the four bend lines converge at a point, in the practice of folding sheet metal which of necessity has thickness, the lateral fold lines transit into a curved fold line at their junctures, and the maximum rate of curvature of this curved fold line is a function of the thickness of the metal being folded.

Referring now to the drawings, particularly FIGS. 5 to 8A inclusive, I will now describe the steps through which I preferably go to form a useful object by means of my invention. In the illustration to be given I propose to form a handle indicated generally at 10 in FIGS. 14A and 15.

In FIG. 5 I show in somewhat diagrammatic manner a piece of apparatus which is effective to commence the folding of the blank indicated at B, FIG. 6A. Thus, the apparatus may embody a base portion 11 and a movable head 12 carrying a depending former 13. The former 13 is curved as viewed in plan to correspond to the bend line 14 which has been indicated in dotted lines on FIG. 6A of the blank. The head 12 may be guided for vertical reciprocation relative to the base 11 by means of a pair of rods 16 or the like.

Carried by the upper surface of the base 11 is a sheet or layer of resilient material 17 such as die rubber. Instead of using die rubber or like resilient material I may in some circumstances, simply cut a groove in the top surface of the base 11.

Referring specifically to the operation to be performed upon the blank B, the blank is laid upon the upper surface of the resilient pad or the like 17 and the movable head is then brought forceably downward onto it as shown in FIG. 7. This causes a folding of the material along the line 14 as shown in FIG. 7. In view of the fact that the particular blank B selected as the example herein is to be folded identically on both sides the blank B may then be turned around so that the other side may be folded as illustrated in FIG. 8. After the first folding operation the blank appears as in FIG. 7A; after the second folding operation the blank appears as in FIG. 8A.

Referring now to FIGS. 9 to 20 inclusive, I will now describe a form of apparatus which is effective to receive the blank indicated in FIG. 8A and form it, finally, to the shape shown in FIGS. 10, 15 and 21.

Essentially, my improved apparatus comprises two parts. First, there is an inner section indicated generally by the numeral 18. The inner section 18 may further be defined as comprising identical portions 19 and 21 hinged together as at 20. The sections or wings 19 and 21 may be formed of sheet material such as relatively heavy plates which are bent or rolled into the shape desired for the inner side or surface of the part to be formed, in this case the inner surface 10A of the handle 10.

The apparatus comprises a second major section indicated generally by the numeral 22 and herein referred to as a whole as the outer unit or section. The section 22 may comprise a pair of wings 23 and 24 made of curved plate and which collectively have the curvature and shape of the outer surface $10^b$ of the handle to be formed. These sections 23 and 24 are hinged together at 26.

The section 22 also comprises articulated, curved plate members 27 and 28 which are shaped to the curvature of the sides $10^c$ of the handle 10 to be formed. Thus, the side sections comprise plates 27 and 28 which are hinged at 29. The plates 27 are hinged respectively to the wings 23 and 24 by hinges 31 and 32 while the plates 28 are hinged respectively to the wings or sections 23 or 24 by hinges 33 and 34.

FIGS. 16, 18 and 20 illustrate in perspective form the apparatus with the two main sections separated each from the other and show the same, as stated, respectively, in completely unfolded position, partially folded position, and completely folded position.

Assuming that a blank to form the relatively simple handle 10 has been pre-bent by use of the apparatus shown in FIGS. 5, 6, 7 and 8, whereby there has been produced the partially bent blank as shown in FIG. 8A, such blank is now laid in the apparatus, resting on the wings or portions 23 and 24. The innermost unit 18 of the apparatus is now placed on the inner surfaces of the partially bent blank B. The two sections of the apparatus are held together, with the blank between the same, and then the wings 27–28 of the section 22 are brought from their outfolded or flat positions through the various stages to finally come to the fully folded positions illustrated in FIGS. 14 and 20. During this up movement of the wings 27–28 the blank is engaged in such fashion that the partially formed sides $10^c$ are brought from such partially formed position to the fully formed position shown in, for instance, FIG. 21. At the same time, and simultaneously with the enfolding of the sides $10^c$, the main body portion of the blank B is taking the configuration of the surfaces of the wings 23–24, as dictated also by the complimentary shape of the wings 19 and 21 of the inner section 18. Thus, the blank in all directions and in all curvatures is being simultaneously folded.

Analyzing the apparatus more closely, it will be seen that in effect the shape of the unfolded apparatus need only approximate the shape of the pre-bent blank, namely the shape shown in FIG. 8A after it leaves the apparatus 12. However, as the bending progresses the shape of the apparatus continually approaches the final shape of the desired part until finally when the apparatus closes upon the part completely the walls thereof in fact are the exact shape desired for the part.

It will now be apparent that the arrangement of the axes of rotation of the several wings of both sections of the apparatus, namely 18 and 22, are in accordance with the disposition of fold lines as explained with respect to FIG. 1 of the drawings. Thus, the hinges 33, 32, 29 and 26 lie on axes of rotation which represent the fold lines according to the system of folding as explained in FIG. 1. Thus the hinges 33 and 32 represent the lateral fold lines. They lie at an angle other than a straight angle, insofar as the axes of rotation are concerned. Hinge 26 represents the axial line which folds in the same direction as the fold across the lateral lines. Hinge 29 of the wing sections 27–28 represents the axial line which is to fold in the direction opposite from the lateral fold lines and lies within the angle which is formed by the lateral lines and which is less than 180°. It will thus be apparent that the apparatus described herein conforms precisely to the geometrical principles diagrammaticallly set forth in FIG. 1 of the drawings and furthermore that its construction and function can be clearly distinguished from the operations diagrammatically illustrated in FIGS. 2, 3 and 4.

It will further be noted that the apparatus for bending the blank is an extremely simple piece of equipment. While I have illustrated the same as being hand operated it will be apparent to those skilled in the art that in practice it would be automated and that other refinements such as perhaps the use of additional hinge lines might be incorporated into the same. In any event the principles shown herein are capable of being employed to fabricate in efficient, simple and inexpensive manner a large variety of relatively complicated as well as relatively simple sheet metal structures.

As further examples of the utility of my invention attention is now called to FIGS. 22 to 26 inclusive. In FIG. 22 I illustrate a blank 36 which may be used to form a hood for a range or stove and which is illustrated in FIG. 22A. First, the blank is of sheet metal, of course, and is peripherally shaped to obtain the structure shown in FIG. 22A including the valance 36$^a$. In starting the bending or folding operation of the blank 36 the bend is started by means of a former such as the one shown at 13 except that it would be shaped to correspond to the shape and curvature of the line 36$^b$. The blank is then put into a machine made up of flat and curved, hinged plates, according to the principles of the apparatus already described. This relatively complicated sheet metal body thus can be manufactured in accordance with my invention from a single piece of sheet metal without the use of drawing dies and without stretching, slitting, crumpling or rejoining any portion of the sheet.

In FIGS. 23 and 23A I show again another example of a fairly complicated leg for a table, stool or the like which can be formed following the teaching of my invention from a flat sheet of metal. The blank 37 is bent along the lines 37$^a$ by a former and then placed in a machine embodying plates which are hinged together and shaped to the desired curvature. The bending takes place along said lines 37$^a$ as illustrated in FIG. 23 while simultaneously the other curved sections are formed by the hinged plate sections of the apparatus which would be specifically made, of course, to form the shape in question.

In FIGS. 24, 24A and 24B I illustrate a drawer pull made from a blank 38. The blank 38 is formed along the lines 38$^a$ and placed in a machine embodying the principles of the one specifically disclosed. All of the bending operations take place at one time to produce the article shown in FIG. 24A and 24B.

In FIG. 25 I show a blank 39 for forming a table. The blank is bent along the lines 39$^a$ and then it is put into a machine properly equipped with the properly shaped flat and curved plates, hinged together. The folding operation commences along the lines 39$^a$ and continued inward movement of the sides of the sheet finally produces the table shown in FIG. 25A.

In FIG. 26 I show a blank 41 from which may be formed a still more complicated item such as the dust pan with pour spout as shown in FIG. 26A. In this instance the blank 41 is bent along the lines 41$^a$ by a former. This thus bent blank is carried to a machine which is composed again of hinged plates which may have curved and flat sections as appropriate. The item shown in FIG. 26A, again, can be formed from the blank shown in FIG. 26 without stretching the material. Thus, the relatively complicated shape of FIG. 26A can readily be formed following the teaching of my invention.

In view of the foregoing it will be apparent that I have devised an improved process and apparatus fully effective for the production of a large number of relatively complicated as well as simple sheet metal structures, devices and objects. My invention is to be particularly distinguished from those type of sheet metal folding and bending operations in which the metal is scored or weakened along certain lines in order to induce it to bend or to form or deflect along such lines. Therefore, in all objects formed by my improved process and apparatus the full strength of the metal not only is maintained due to lack of weakening along such lines, but strength is attained also because of the relative dispositions of the curved sections to each other or to flat sections. My invention is further characterized by the making of impressions by the former on the sheet to be formed or bent thereby permitting the use of a very simple final bending mechanism.

While I have shown my invention in several forms, it will be obvious to those skilled in the art that it is not so limited but is susceptible of various other changes and modifications without departing from the spirit thereof.

I claim:

1. The process of forming, by folding, a sheet metal structure which is developable without slitting, by folding a sheet of metal without stretching, crumpling or tearing said sheet which structure has at least two adjacent surface segments which collectively form a complex surface and is further characterized in that straight bend lines meet at a curved bend line upon the complex surface and the images of those straight bend lines when projected on the developed pattern of said structure meet upon the projected image of the curved bend line upon the developed pattern, comprising:

a. commencing the folding of said metal along selected curved bend lines, and b. simultaneously folding the metal along said straight bend lines and along said curved bend lines.

2. In apparatus for forming, by folding, a sheet metal structure which is developable without slitting, by folding a sheet of metal without stretching, crumpling or tearing said sheet which structure has at least two adjacent surface segments which collectively form a complex surface, which surface is further characterized in that straight bend lines meet at a curved bend line upon the complex surface and the images of those straight bend lines when projected on the developed pattern of said structure meet upon a projected image of the curved bend line upon the developed pattern comprising:

a. a multisection, articulated folder in which at least some of the working surfaces of the sections are single curved surfaces, b. said sections being pivotally connected to one another along the intersections of curved surfaces of said sections and selected elements of curved surfaces of the sections, and c. the pivotal axes of said sections relative to each other being arranged to cause simultaneous folding of all of said sections.

3. Apparatus as defined in claim 2 in which the working surfaces of said folder comprise both single curved and plane surfaces.

4. Apparatus as defined in claim 2 in which there is a separate, inner section for said apparatus comprising at least two parts hinged together and having working surfaces adapted to engage the sheet metal to be folded and hold it in place in said folder, said working surfaces being shaped substantially to correspond to the final shape of the inner surfaces of the structure to be folded.

* * * * *

Disclaimer 3,952,574.—*John A. Speidel*, Maineville, Ohio. PROCESS AND APPARATUS FOR FORMING SHEET METAL STRUCTURES. Patent dated Apr. 27, 1976. Disclaimer filed May 11, 1977, by the inventor.

Hereby enters this disclaimer to claim 1 of said patent.

[*Official Gazette July 26, 1977.*]